US008098830B2

(12) United States Patent
Coker et al.

(10) Patent No.: US 8,098,830 B2
(45) Date of Patent: Jan. 17, 2012

(54) METHOD AND APPARATUS FOR REDUCING NOISE IN AN AUDIO SIGNAL

(75) Inventors: Guy Coker, Rocklin, CA (US); James Purcell, Roseville, CA (US)

(73) Assignee: Line 6, Inc., Calabasas, CA (US)

( * ) Notice: Subject to any disclaimer, the term of this patent is extended or adjusted under 35 U.S.C. 154(b) by 740 days.

(21) Appl. No.: 12/236,124

(22) Filed: Sep. 23, 2008

(65) Prior Publication Data

US 2009/0086984 A1 Apr. 2, 2009

Related U.S. Application Data

(60) Provisional application No. 60/976,986, filed on Oct. 2, 2007.

(51) Int. Cl.
*H04R 5/00* (2006.01)

(52) U.S. Cl. ..... 381/16; 381/13; 381/94.1; 381/120

(58) Field of Classification Search ..... 381/1–16, 381/94.1–74.9, 120
See application file for complete search history.

(56) References Cited

U.S. PATENT DOCUMENTS

| | | | | |
|---|---|---|---|---|
| 7,024,155 | B2 | 4/2006 | Gosieski, Jr. | |
| 2006/0217145 | A1 * | 9/2006 | Pace | 455/550.1 |
| 2009/0310790 | A1 * | 12/2009 | Sinton et al. | 381/2 |

* cited by examiner

*Primary Examiner* — Cuong Q Nguyen
(74) *Attorney, Agent, or Firm* — Blakely Sokoloff Taylor & Zafman, LLP

(57) ABSTRACT

A technique for reducing inherent noise in a real time digital audio wireless system. The technique allows for low power stereo analog to digital and digital to analog converters to be used in a battery operated real time digital audio wireless applications. The audio signal is sent to the left and right channels of an analog to digital converter with a preceding audio amp of different gain at the input to each channel. The signals are simultaneously digitized then combined to generate a new digital value resulting in noise reduction at lower amplitudes. This new data word is then transmitted via radio waves to a digital audio receiver. Once the data is received it is output simultaneously to a stereo digital to analog converter. The digital to analog conversion of both left and right channels is then summed using a resistor network and an audio amplifier. The audio amplifier output is then reduced to create further reduction of noise at all amplitudes.

17 Claims, 2 Drawing Sheets

METHOD AND APPARATUS FOR REDUCING NOISE IN AN AUDIO SIGNAL

CROSS-REFERENCE TO RELATED APPLICATION

This application claims the benefit of U.S. Provisional Patent Application No. 60/976,986 filed Oct. 2, 2007.

BACKGROUND OF THE INVENTION

1. Field of the Invention

The present invention relates generally to noise reduction circuits, and more particularly to a method and apparatus for reducing noise in an audio signal.

2. Prior Art

Reducing noise and/or extending dynamic range is very common. The standard way of reducing noise or extending dynamic range for an analog audio signal for wireless transmission is by using a compander (compression and expansion) circuit. Conventional companding amplifiers typically employ circuitry that compresses an audio input signal using a full wave rectifier and peak detector. Then an expanding amplifier uses the peak amplitude for the amount of expansion.

A compander will always affect the analog signal in a negative fashion by causing some compression and noise floor modulation due to the lag time of the expansion circuit. These negative aspects are unacceptable in the pro audio market when high fidelity is required. The alternative is to use digital converters and obtain the required signal integrity. Digital converters have limited dynamic range depending on the amount of power used and technology available and therefore, low power analog to digital converters cannot usually accommodate both the very small and very large signals required in a pro audio environment. 16-20 bits is standard accuracy of existing converters and at 6 dB of dynamic range per bit of accuracy 96 dB-120 dB is the current attainable range. An analog to digital converter with 120 dB of dynamic range uses 3-4 times the power of one with 96 dB of dynamic range. Wireless audio applications require a large dynamic range and usually require battery operation making a suitable converter usable.

The present invention satisfies the need of the pro audio environment by overcoming the audio deficiencies of companders and the power deficiencies of analog to digital and digital to analog converters

SUMMARY OF TE INVENTION

The present invention reduces noise in a bandwidth limited digital audio wireless environment. The reduction of noise allows for the removal of analog companding circuitry in wireless audio devices. The present invention comprises two audio amplifiers with differing gains, a stereo analog to digital converter, two microprocessors, a stereo digital to analog converter and a differential amplifier. An audio input signal is amplified at two differing gain levels and simultaneously digitized. The digitized data is manipulated by a microprocessor that provides data analysis and data framing in preparation for radio transmission. The data is sent via radio waves to a radio-receiving device. The digital data stream is then duplicated and sent to a stereo digital to analog converter. The analog output is then averaged via a differential amplifier and output to an end user audio source. The result is a reduced noise version of the original signal.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
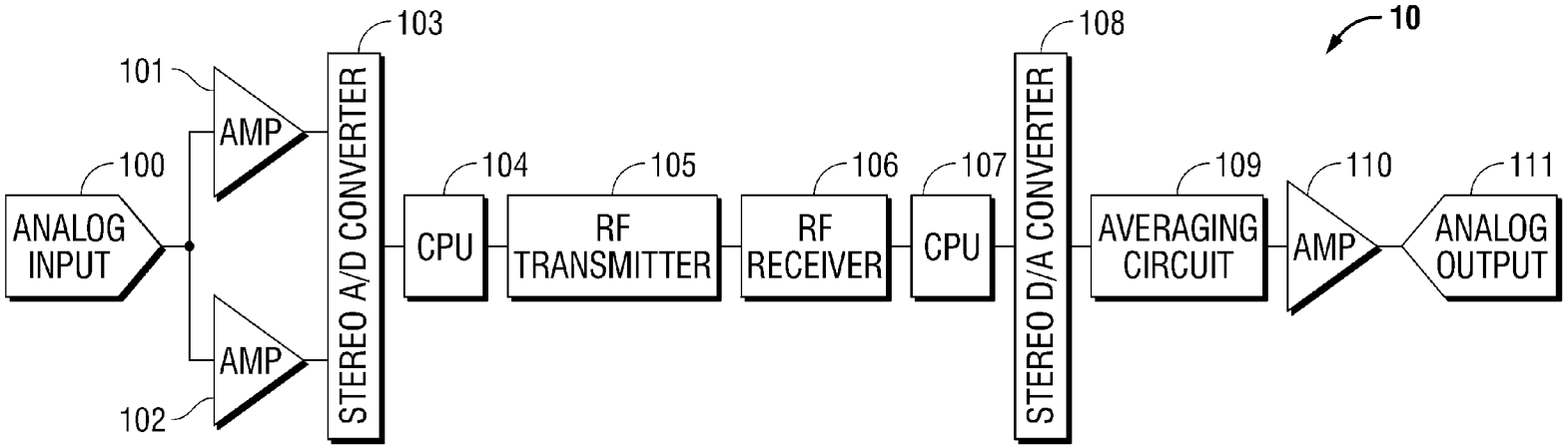
FIG. 1 is a schematic block diagram showing the functional elements of a real time digital audio wireless system with noise reduction in accordance with the present invention.
Figure 2:
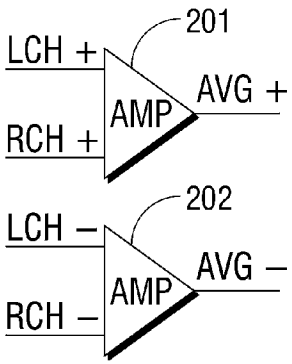
FIG. 2 is a schematic block diagram showing the averaging circuit shown in FIG. 1.
Figure 3:
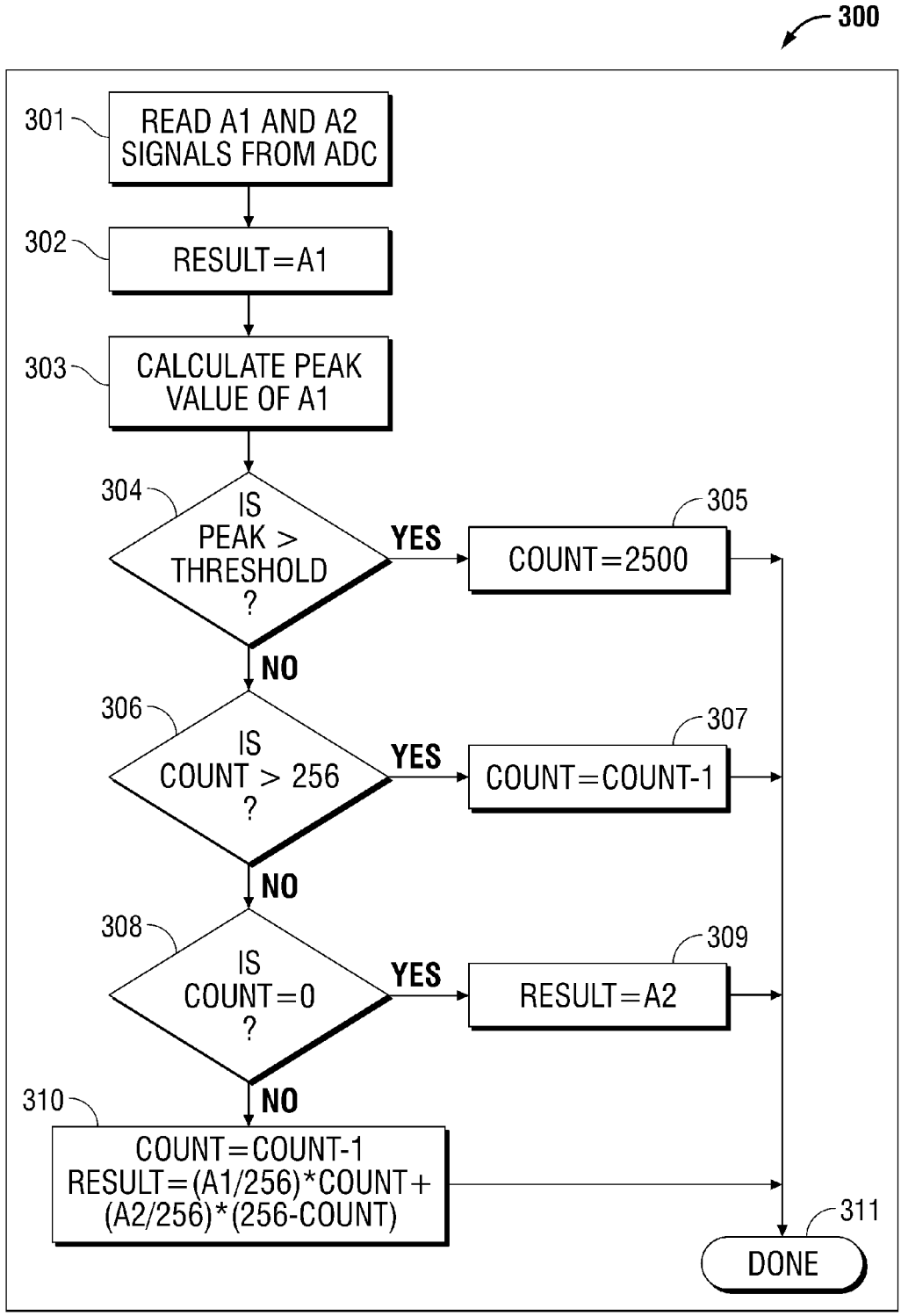
FIG. 3 is a flow chart showing the noise reduction method employed in the transmitter microprocessor (CPU 104) shown in FIG. 1.

Referring to FIGS. 1 through 3, wherein like reference numerals refer to like components in the various views, there is illustrated therein a new and improved method and apparatus for reducing noise in an audio signal, generally denominated 10 herein.

Referring to FIGS. 1-3, there is shown a preferred embodiment of the method and apparatus for reducing noise in an audio signal of the present invention. In the instant description, reference to "one embodiment" or "an embodiment" mean that the feature being referred to is included in at least one embodiment of the present invention.

FIG. 1 shows an example of a digital audio wireless system in which the present noise reduction technique can be implemented, to provide advantages over prior art wireless systems. The system in FIG. 1 includes an analog input 100, first and second audio amplifiers, A1 and A2, denominated, respectively, 101, 102, with differing gain. The system further includes a stereo analog-to-digital converter 103, a first CPU 104, an RF transmission device 105, an RF receiving device 106, a second CPU 107, a stereo digital-to-analog converter 108, an averaging circuit 109, and a differential amplifier 110.

An analog input waveform is received by the two audio amplifiers 101, 102 via a microphone, instrument, or other appropriate interface. The audio amplifiers 101, 102 send the signal to an analog-to-digital converter 103. The first amplifier 101 has 0 dB gain and the second amplifier 102 has predetermined noise reduction amount of gain. This noise reduction gain is equal to the approximate amount of noise requiring reduction in dB units. The stereo ADC 103 in FIG. 1 simultaneously digitizes the two analog amplifier outputs.

The transmitter microprocessor 104 collects the left and right channel data streams from the analog-to-digital converter. Note that audio amplifiers that perform the above functions are well known; however such amplifiers do not perform the noise reduction technique of the present invention.

The transmitter microprocessor 104 keeps track of count value (Count), which is initialized to a value of 2500. This value is used to add some smoothing of the switch between the two ADC (analog-to-digital converter 103) channels. A common signal is applied to two amplifiers. The first amplifier 101 has unity gain. The second amplifier 102 has a gain of 18 db. Samples from the ADC are in a signed displacement 2s complement binary format. The gain of amplifier 102 is chosen to match the value of a 2s complement binary value shifted to the right 3 bits. Every shift of binary representation of an umber is approximately equal to a 6 db change, such that the 3-bit shift is approximately equal to 18 db.

Referring now to FIG. 3, both the first and second amplifier signals ADC samples are read 301 by the transmitter microprocessor 104 and stored in a buffer at a constant sampling rate. The absolute value of the A1 signal is determined 302, and a peak value of the signal from the first amplifier 101 is calculated 303 using the absolute value of the signal. The peak value is then compared to the threshold value of (Max ADC Positive Count/noise reduction gain amount)*90%. At decision block 304, if the peak value is at any time above the threshold value, the transmitter microprocessor will choose the first amplifier 101 sample to process, and the Count is set 305 to a value of 2500. At decision block 304, if the peak value is below the threshold, and Count=0, then the transmitter microprocessor will choose the second amplifier 102 sample to process. At decision block 306, when the peak value is below the threshold value and the Count is greater than 256, then the transmitter microprocessor will choose the first amplifier 101 sample to process and the Count is set to 307 at Count−1. At decision block 306, when the peak value is below the threshold and the Count is less than 256, then the microprocessor will pass the signal to a new decision block 308, and if the Count=0, the microprocessor will choose 309 the second amplifier sample; if the Count≠0, then the transmitter microprocessor will apply and use the result of the formula (A1/256)*Count+(A2/256)*(256−Count) 310. This formula is used to smooth the transition from the A1 signal to the A2 signal. Processing is completed 311 at this point and the signal is transmitted by RF transmitter 105 to RF receiver 106, incorporated in or otherwise in electronic communication with receiver microprocessor 107.

The receiver microprocessor 107 in FIG. 1 captures and stores the transmitted data into a buffer and performs checks to verify the captured data is correct. The transmitted data is sent in a mono format. The receiver microprocessor 107 in FIG. 1 converts the captured data into a stereo format to send to the DAC 108, which outputs the captured data on the left and right channel outputs. The two outputs are then averaged through an averaging amplifier circuit 109, comprising first and second averaging amplifiers 201, 202 (see FIG. 2). The signal is then attenuated by a factor of two through a summing amplifier 110 in order to restore the amplitude back to the original signal level and provide an analog output 111 with enhanced noise reduction. The process of averaging the two signals has the effect of enhancing the noise reduction by an additional 3 dB therefore improving the noise floor of the system even further.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. A digital audio wireless apparatus comprising:

a stereo analog to digital converter with a separate audio amplifier of differing gain on left and right channel inputs;

a microprocessor used to combine the left and right channel data, substantiate noise reduction and send a newly combined audio sample data stream to a radio transmission device;

a radio transmission receiving the outputting the data stream to a microprocessor; and a digital to analog converter outputting the audio data to an analog summing device.

2. A method of reducing noise in a digital audio wireless device comprising the steps of:

(a) simultaneously digitizing an analog audio input signal with a stereo analog to digital converter, (b) amplifying each input to the stereo converter with differing gains;

(c) continuously monitoring audio level input data using one channel of the stereo analog to digital converter;

(d) using continuously monitored data to analyze the capability of reducing noise on digitally converted audio signals;

(e) performing noise reduction with one or both digital bit streams from analog to digital converter based on monitor channel input data;

(f) continuously radio transmit and receive noise reduced data;

(g) outputting noise reduced data to a stereo digital-to-analog converter;

(h) summing the outputs of the stereo digital-to-anatog converter;

(i) dividing the analog audio output.

3. The method according to claim 2, wherein one of the differing gains in step (b) is unity.

4. The method according to claim 2, wherein one of the differing gains in step (b) is equal to the amount of noise reduction in dB.

5. The method according to claim 2, wherein the monitored audio level in step (b) is the unity gain channel.

6. The method according to claim 2, wherein the decision to reduce noise in step (d) is derived from measuring the unity gain channel data and applying the threshold formula.

7. The method according to claim 1, wherein the threshold formula is (Max ADC Count/noise reduction gain amount)* 90%.

8. The method according to claim 7, wherein Max ADC count is the max value of the analog-to-digital converter.

9. The method according to claim 7, wherein noise reduction gain amount is the amount of gain on the noise reduction amplifier.

10. The method according to claim 2, wherein the amplified signal of step (e) is digitally divided by the amount of noise reduction gain and combined with the unity gain signal.

11. The method according to claim 2, wherein the newly combined audio data of step (f) is continually output from first microprocessor to radio transmission device.

12. The method according to claim 2, wherein newly combined audio data of step (f) is continually received into second microprocessor via radio reception device.

13. The method according to claim 2, wherein newly combined audio data of step (g) is continually output from second microprocessor to left and right channels of stereo digital to analog converter.

14. The method according to claim 2, wherein the output of left and right channels of stereo digital-to-analog converter at step (h) are averaged together producing one output signal with 6 dB of gain.

15. The method according to claim 14, wherein the output of left and right channels of stereo digital-to-analog converter at step (h) is averaged together using a resistor network to obtain 6 dB of gain.

16. The method according to claim 2, wherein the averaged audio output in step (i) is divided by 2.

17. The method according to claim 16, wherein the division by 2 is performed with a differential amplifier.

* * * * *